US009625208B2

(12) United States Patent
Chantant

(10) Patent No.: US 9,625,208 B2
(45) Date of Patent: Apr. 18, 2017

(54) METHOD AND APPARATUS FOR LIQUEFYING A GASEOUS HYDROCARBON STREAM

(75) Inventor: Francois Chantant, The Hague (NL)

(73) Assignee: SHELL OIL COMPANY, Houston, TX (US)

( * ) Notice: Subject to any disclaimer, the term of this patent is extended or adjusted under 35 U.S.C. 154(b) by 2134 days.

(21) Appl. No.: 12/668,582

(22) PCT Filed: Jul. 10, 2008

(86) PCT No.: PCT/EP2008/059051

§ 371 (c)(1),
(2), (4) Date: Jan. 11, 2010

(87) PCT Pub. No.: WO2009/007439

PCT Pub. Date: Jan. 15, 2009

(65) Prior Publication Data

US 2010/0192626 A1 Aug. 5, 2010

(30) Foreign Application Priority Data

Jul. 12, 2007 (EP) ..... 07112361

(51) Int. Cl.

| | |
|---|---|
| ***F25J 1/00*** | (2006.01) |
| ***F25J 1/02*** | (2006.01) |
| ***F25J 3/02*** | (2006.01) |

(52) U.S. Cl.

CPC ..... *F25J 1/0237* (2013.01); *F25J 1/0022* (2013.01); *F25J 1/0035* (2013.01); *F25J 1/0042* (2013.01);

(Continued)

(58) Field of Classification Search

CPC ..... F25J 1/0022; F25J 1/0223; F25J 1/0042; F25J 1/0221; F25J 1/0237; F25J 3/0209;

(Continued)

(56) References Cited

U.S. PATENT DOCUMENTS 2,975,604 A * 3/1961 McMahon ..... 62/614
3,194,025 A * 7/1965 Grossmann ..... 62/614

(Continued)

FOREIGN PATENT DOCUMENTS

DE 1960515 * 5/1971 ..... F25J 1/02
DE 1960515 5/1998 ..... F25J 1/00

(Continued)

OTHER PUBLICATIONS

Foerg Wolfgang, Translation of DE1960515, May 1971, all pages.*

*Primary Examiner* — Frantz Jules
*Assistant Examiner* — Webeshet Mengesha

(57) ABSTRACT

A method and apparatus for liquefying a gaseous hydrocarbon stream such as natural gas. The method comprises at least the steps of providing a feed stream (10) and dividing the feed stream (10) to provide at least a first stream (20) and a second stream (30). The first stream (20) is liquefied using heat exchange against a liquid nitrogen stream (40) to provide a first liquefied hydrocarbon stream (60) and an at least partly evaporated nitrogen stream (70). The second stream (20) is cooled and liquefied by heat exchanging against the at least partly evaporated nitrogen stream (70) to provide a second cooled hydrocarbon stream (80).

17 Claims, 3 Drawing Sheets

(52) U.S. Cl.
CPC ..... *F25J 1/0221* (2013.01); *F25J 1/0223* (2013.01); *F25J 3/0209* (2013.01); *F25J 3/0233* (2013.01); *F25J 3/0238* (2013.01); *F25J 2200/02* (2013.01); *F25J 2200/74* (2013.01); *F25J 2205/04* (2013.01); *F25J 2210/06* (2013.01); *F25J 2210/42* (2013.01); *F25J 2230/20* (2013.01); *F25J 2230/30* (2013.01); *F25J 2240/12* (2013.01); *F25J 2270/14* (2013.01); *F25J 2270/904* (2013.01)

(58) Field of Classification Search
CPC ..... F25J 3/0233; F25J 3/0238; F25J 2200/02; F25J 1/0035; F25J 2200/74; F25J 2205/04; F25J 2210/06
USPC ..... 62/606, 611, 613, 614, 616, 618, 619, 62/621
See application file for complete search history.

(56) References Cited

U.S. PATENT DOCUMENTS

| | | | | |
|---|---|---|---|---|
| 3,224,207 | A | 12/1965 | Feist et al. | 62/9 |
| 3,383,873 | A * | 5/1968 | Becker | 62/613 |
| 3,400,547 | A * | 9/1968 | Williams et al. | 62/50.1 |

FOREIGN PATENT DOCUMENTS

| | | | |
|---|---|---|---|
| FR | 1542232 | 10/1968 | |
| GB | 918119 | 2/1963 | |
| GB | 1596330 | 8/1981 | F25J 1/02 |
| WO | WO2008009930 | 1/2008 | F25J 1/02 |

* cited by examiner

METHOD AND APPARATUS FOR LIQUEFYING A GASEOUS HYDROCARBON STREAM

The present application claims priority from European Patent Application 07112361.6 filed 12 Jul. 2007

FIELD OF THE INVENTION

The present invention relates to a method and apparatus for liquefying a gaseous hydrocarbon stream such as natural gas.

BACKGROUND OF THE INVENTION

Several methods of cooling, usually liquefying, a natural gas stream thereby obtaining liquefied natural gas (LNG) are known. It is desirable to liquefy a natural gas stream for a number of reasons. As an example, natural gas can be stored and transported over long distances more readily as a liquid than in gaseous form because it occupies a smaller volume and does not need to be stored at high pressures.

As an example of liquefying natural gas, the natural gas, comprising predominantly methane, enters an LNG plant at elevated pressures and is pre-treated to produce a purified feed steam suitable for liquefying at cryogenic temperatures. The purified gas is processed through a plurality of cooling stages using heat exchangers to progressively reduce its temperature until liquefaction is achieved.

Especially for long distance transportation, the liquefied natural gas can be carried in a sea-going vessel between, for example, an export terminal and an import terminal. On its return journey, the sea-going vessel can transport another liquefied gas such as liquid nitrogen, whose cold energy can then be used in the liquefaction of natural gas.

GB 1 596 330 relates to a process for the production of a liquefied natural gas on a sea-going vessel, where liquid nitrogen is passed through a heat exchanger situated on board the vessel to liquefy gaseous natural gas. All of the cold energy of the liquid nitrogen is used against one stream of natural gas, thus making the energy-matching of the liquefaction and the evaporation of the two streams difficult to balance.

DE 1 960 515, with reference to FIGS. 1 and 2 therein, discloses methods for liquefying a pressurized natural gas stream by heat exchanging against liquid nitrogen, wherein about two thirds of the gas is expanded in a turbine to a pressure of 1.1 ata and liquefied in a heat exchanger by heat exchanging against the liquid nitrogen which evaporates as a result. About one third of the gas is compressed to a high pressure of 200 ata with the aid of work released by the expansion of the about two thirds of the gas in the turbine, and expansion of the evaporated nitrogen stream in a turbine. The high-pressure natural gas is then cooled in a heat exchanger, depressurized to a pressure of 20 ata over a valve and further cooled and liquefied by heat exchanging against the vaporized and the expanded nitrogen.

FIG. 3 of DE 1 960 515 illustrates a method wherein about one third of the incoming natural gas is liquefied at pipeline pressure by heat exchange with the expanded nitrogen vapour and another refrigerant cycled in an additional refrigeration cycle, with for example a hydrocarbon mixed stream as the other refrigerant. This method needs the additional refrigeration cycle.

DE 1 960 515 thus presents different embodiments aiming at maximising the amount of natural gas that can be liquefied for each kg of liquid nitrogen, but a drawback of DE 1 960 515 is that the equipment count is rather high.

SUMMARY OF THE INVENTION

The present invention provides a method of liquefying a gaseous hydrocarbon stream, the method at least comprising the steps of:

(a) providing a feed stream comprising the gaseous hydrocarbon stream at an elevated pressure;

(b) dividing the feed stream of step (a) to provide at least a first stream and a second stream;

(c) expanding the first stream or compressing the second stream, or both;

(d) liquefying the first stream downstream of step (c) using heat exchanging against a liquid nitrogen stream, to provide a first liquefied hydrocarbon stream and an at least partly evaporated nitrogen stream; and (e) cooling and liquefying the second stream downstream of step (c) by heat exchanging against the at least partly evaporated nitrogen stream of step (d) without invoking a significant change in pressure of the evaporated nitrogen stream other than a de minemus operational pressure loss caused by the present heat exchanging of step (e) and passing the evaporated nitrogen stream from the heat exchanging of step (d) to the present heat exchanging of step (e).

In a further aspect, the present invention provides an apparatus for liquefying a hydrocarbon stream, the apparatus at least comprising:

a stream splitter to divide the hydrocarbon stream into at least a first stream and a second stream;

a pressure modification stage comprising a first expander to receive and expand first stream or a compressor to receive and compress the second stream, or both;

a first cooling system, downstream of the pressure modification stage, through which the first stream and a liquid nitrogen stream can heat exchange to provide a first liquefied hydrocarbon stream and an at least partly evaporated nitrogen stream;

a second cooling system, downstream of the pressure modification stage, through which the second stream and the at least partly evaporated nitrogen stream can heat exchange against the at least partly evaporated nitrogen stream, to provide a second liquefied hydrocarbon stream and a warmed nitrogen stream at substantially the same pressure as the at least partly evaporated nitrogen stream, and a connection conduit, free from pressure modification means and fluidly connecting the first cooling system to the second cooling system, to allow at least partly evaporated nitrogen stream to pass from the first cooling system to the second cooling system without invoking a significant change in pressure other than a de minemus operational pressure loss caused by passing the evaporated nitrogen stream from the first cooling system to the second cooling system.

BRIEF DESCRIPTION OF THE DRAWINGS

Embodiments of the present invention will now be described by way of example only, and with reference to the accompanying non-limiting drawings in which.

DETAILED DESCRIPTION OF THE REFERENCED EMBODIMENT

For the purpose of this description, a single reference number will be assigned to a line as well as a stream carried in that line. Same reference numbers refer to similar components.

The present invention provides an improved method and apparatus for cooling a gaseous hydrocarbon stream such as natural gas. The improvement lies in the fact that the method and apparatus may deliver a liquefied hydrocarbon stream by using the cold vested in liquid nitrogen at a sufficiently high efficiency to allow operation within commercial and practical constraints, at a relatively low equipment count and/or operational complexity.

Figure 1:
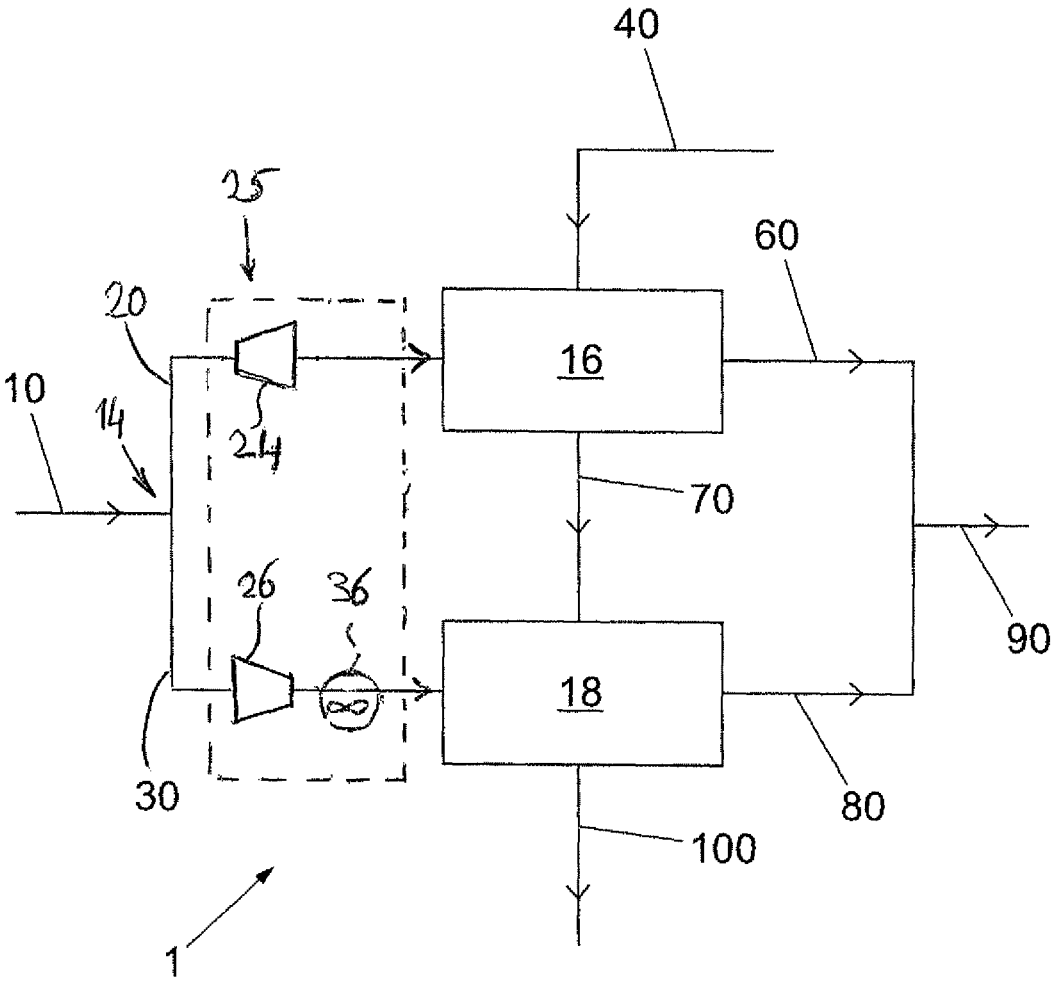
FIG. 1 is a general scheme of part of an LNG facility according to a first embodiment of the present invention.

FIG. 1 generally illustrates an apparatus for liquefying a hydrocarbon stream 10, such as natural gas. This apparatus may represent a general arrangement of part of a liquid natural gas (LNG) facility 1.

The apparatus comprises:

a stream splitter 14 to divide the hydrocarbon stream 10 into at least a first stream 20 and a second stream 30;

a pressure modification stage 25 comprising one or more compressors 26, expanders 24 or both to change the pressure of the first stream 20, the second stream 30, or both;

a first cooling system 16 through which the first stream 20 and a liquid nitrogen stream 40 can heat exchange to provide a first liquefied hydrocarbon stream 60 and an at least partly evaporated nitrogen stream 70;

a second cooling system 18 through which the second stream 30 and the at least partly evaporated nitrogen stream 70 can heat exchange to provide a second liquefied hydrocarbon stream 80; and, optionally, a combiner to combine the first liquefied hydrocarbon stream 60 and the second liquefied hydrocarbon stream 80 to provide a combined hydrocarbon stream 90, preferably being liquefied natural gas.

The pressure modification stage may in particular comprise a first expander 24 to expand the first stream 20 prior to the first cooling system 16 and/or a first compressor 26 to compress the second stream 30 prior to the second cooling system 18.

The combiner may be any suitable arrangement, generally involving a union or junction or piping or conduits, optionally involving one or more valves.

A second expander may be provided upstream of the combiner, to expand the second liquefied hydrocarbon stream 80 prior to combining it with the first liquefied hydrocarbon stream 60.

The invention is based on the insight that in a commercially practical operation, where a sea going tanker typically brings in the nitrogen and removes the liquefied hydrocarbon product in the same tanks, it is overall most efficient to be able to replace the volume of nitrogen with as close as possible the same volume of cooled and liquefied hydrocarbon stream, generally within ±10 vol %. Thus, it has been found that there is no need to fully maximize the amount of liquefied hydrocarbon product relative to the amount of nitrogen, because one would need other ways to ship the excess volume of liquefied hydrocarbon product out.

This insight allows for a reduction in equipment compared to the process disclosed in DE 1 960 515, even at the cost of liquefaction efficiency.

There are various options, alone or in combination, to simplify the method and/or apparatus for liquefaction.

In a first group of embodiments, the second stream 30 is cooled and liquefied—downstream of the pressure modification stage 25—by heat exchanging against the at least partly evaporated nitrogen stream 70 released from the first cooling system 16 without invoking a significant change in pressure of the evaporated nitrogen stream other than a de minemus operational pressure loss caused by the heat exchanging in the second cooling system 18 and passing the evaporated nitrogen stream 70 from the heat exchanging in the first cooling system 16 to the heat exchanging in the second cooling system 18. Herewith a major part of equipment, such as an expander or a compressor, can be saved thereby reducing not only the capital expense but also the maintenance requirements and the complexity of operation in general.

In a second group of embodiments, the second stream 30 is cooled and liquefied—downstream of the pressure modification stage 25—without invoking a significant pressure reduction in the second stream 30 during the cooling and liquefying, other than a de minemus operational pressure loss caused by the heat exchanging in the second cooling system 18, thereby providing the second liquefied hydrocarbon stream at substantially the same pressure as the pressure of the second stream directly after the pressure modification stage. Because no significant change in pressure of the second stream 30 other than a de minemus operational pressure loss needs to be invoked during the cooling and liquefaction, the associated equipment such as pressure modification means and complexity can be omitted.

An advantage of the present invention is that sufficient cold recovery is possible from a volume of liquid nitrogen by liquefying a hydrocarbon stream to produce about the same liquid volume in two streams at two different pressures, without the need to increase the cooling duty and therefore further reducing the energy requirements of the overall liquefying method and plant.

Therefore, in a third group of embodiments, the first stream 20 is cooled and liquefied in the first cooling system 16 by heat exchanging exclusively against the nitrogen stream 40. In a fourth group of embodiments, the second stream 30 is cooled and liquefied in the second cooling system 18 by heat exchanging exclusively against the at least partly evaporated nitrogen stream 70. Preferably, the nitrogen stream 40 and the at least partly evaporated nitrogen stream 70 are not cycled in a compression cycle.

Indeed, by minimizing, removing or avoiding one or more cycled refrigerant streams to assist liquefaction of the first stream, and by dividing the feed stream such that part of it is also cooled and liquefied by the at least partly evaporated nitrogen stream, better matching of the refrigeration duty can be provided, thereby reducing operational cost. This is particularly advantageous where space is restricted for the method and/or plant for liquefaction, such as on a sea-going vessel, where room for other refrigeration circuits or cycles to assist better matching of the liquefying and evaporating streams cannot be accommodated.

Particular embodiments may belong exclusively to one of the above mentioned groups of embodiments, or to two or more of the above mentioned groups of embodiments, depending on the desired liquefaction efficiency and the available room for complexity and equipment.

In some situations, for instance, there may be provided a fixed, pre-determined or arranged volume or amount of liquid nitrogen, such as liquid nitrogen provided from one or more storage tanks on a sea-going vessel. It is then overall most efficient to be able to replace such volume or amount with as close as possible the same volume or amount of cooled and liquefied hydrocarbon stream, generally within ±10 vol %.

It is remarked that U.S. Pat. No. 3,224,207 discloses a method liquefying methane with a nitrogen expansion refrigeration system and ethane, propane and water as further refrigerants. Example II of U.S. Pat. No. 3,224,207 shows natural gas in the first conduit divided, but with each part only cooled to −100° F. (−73° C.) prior to recombination. Thus, no liquefaction of the natural gas has yet occurred, and a separate mechanical refrigeration system is required to liquefy the complete natural gas stream.

In one embodiment of the present invention, the gaseous hydrocarbon stream provided is at a pressure greater than ambient, preferably >10 bar, for example in the range 40-100 bar pressure, such as 60 bar. It is remarked that any mention to a pressure value is given in units of absolute pressure (as opposed to gauge pressure).

One or more of the streams divided from the feed stream in step (b) is subsequently used at a different pressure to one or more other divided streams. In this way, the cooling of the streams divided from the feed stream can be carried out at different pressures. Such different pressures are relative to each other, and may be higher or lower than the pressure of the gaseous hydrocarbon or feed stream.

For example, the pressure of one or more of: the first stream, the second stream, or the first stream and the second stream; may be changed prior to step (d) or step (e) or both of steps (d) and (e).

For the present invention, the first stream may preferably be expanded prior to step (d) to reduce the pressure to for example 1-15 bar.

Also preferably, the second stream may be compressed prior to step (e), such as to >120% of the original pressure, such as 150-300% of the original pressure.

In another embodiment of the present invention, the liquid nitrogen stream is 100% liquid nitrogen, optionally having a small (<10 mol %) fraction of the nitrogen as vapour. Vapour can easily be formed during movement or piping of the liquid nitrogen.

In another embodiment of the present invention, the first liquefied hydrocarbon stream is >50 mol %, preferably >90 mol %, >95 mol %, >98 mol % or even 100 mol % liquefied. Optionally, the second cooled hydrocarbon stream is similarly liquefied prior to combination with the first liquefied hydrocarbon stream.

The liquefaction of the first stream in step (d) may optionally be assisted by heat exchange with one or more other refrigerant streams in addition to the liquid nitrogen stream 40. However, it is intended in the present invention that any cooling provided by the optional one or more other refrigerant streams is <50%, preferably <40%, <30%, <20% or even <10% of the cooling required in step (d) to provide the first liquefied hydrocarbon stream.

In another embodiment of the present invention, >80%, preferably >90%, of the enthalpy difference between the gaseous hydrocarbon stream provided as the feed stream, and the combination of at least first liquefied hydrocarbon stream and second cooled hydrocarbon stream, is provided by the liquid nitrogen stream.

One or more of the first stream, second stream, liquid nitrogen stream, first liquefied hydrocarbon stream and second cooled hydrocarbon stream, may be compressed and/or expanded one or more times in order to assist optimum matching of the refrigerant duty of the liquid nitrogen stream with the first and second streams, and optionally to ensure that the temperature and pressure of the first liquefied hydrocarbon stream and second cooled hydrocarbon stream are the same or relatively close (±10%) if they are combined.

The gaseous hydrocarbon stream may be any suitable hydrocarbon-containing gas stream to be treated, but is usually a natural gas stream obtained from natural gas or petroleum reservoirs. As an alternative the natural gas stream may also be obtained from another source, also including a synthetic source such as a Fischer-Tropsch process.

Usually the natural gas stream is comprised substantially of methane. Preferably the feed stream comprises at least 60 mol % methane, more preferably at least 80 mol % methane.

Depending on the source, the gaseous hydrocarbon stream may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulphur compounds, and the like.

If desired, the gaseous hydrocarbon stream may be pre-treated before using it in the present invention. This pre-treatment may comprise removal of undesired components such as $CO_2$ and $H_2S$, or other steps such as pre-cooling, pre-pressurizing or the like. As these steps are well known to the person skilled in the art, they are not further discussed here.

The person skilled in the art will understand that any steps of reducing or increasing the pressure of a stream may be performed in various ways using any expansion or compression device (e.g. a flash valve, a common expander, a common compressor).

Although the method according to the present invention is applicable to various gaseous hydrocarbon feed streams, it is particularly suitable for natural gas streams to be liquefied.

Further, the person skilled in the art will readily understand that after liquefaction, the liquefied natural gas may be further processed, if desired. As an example, obtained LNG may be depressurized by means of a Joule-Thomson valve or by means of a cryogenic turbo-expander. Also, one or more further processing steps prior to, between and/or each step of the method of the present invention may be performed.

The division of the feed stream could be provided by any suitable divisor, for example a stream splitter. Preferably the division creates at least two streams having the same composition and phases.

The division of the feed stream can be any ratio or ratios between the two or more streams formed by step (b).

In one embodiment of the present invention, there are two streams created in step (b), the first stream being 30 to 70 mass % of the feed stream, and the second stream being the remainder of the mass %. Preferably, the first stream is 45 to 55 mass % of the feed stream.

The cooling of at least the first stream and second stream created in step (b) is effected by heat exchange within one or more heat exchangers known in the art, including kettles and the like. Where two or more heat exchangers are used for cooling, such heat exchangers may be in series, in parallel or both. One or more heat exchangers can provide a cooling system.

Referring again to FIG. 1, the feed stream 10 typically contains natural gas as the gaseous hydrocarbon stream to be cooled. In addition to methane, natural gas can include some heavier hydrocarbons and impurities, e.g. carbon dioxide, nitrogen, helium, water and non-hydrocarbon acid gases. The feed stream 10 is usually pre-treated to separate out these impurities as far as possible, and provide a purified feed stream suitable for cooling, preferably liquefying at cryogenic temperatures.

In operation, the feed stream 10 is divided by a stream splitter 14 into at least two streams having wholly or substantially the same composition, i.e. the same components and phase or phases. The feed stream 10 can be divided into more than two feed streams where desired or necessary.

In the arrangement shown in FIG. 1, 45 to 55 mass % of the feed stream 10 provides the first stream 20, with the remainder being the mass % of the second stream 30. The division of the feed stream 10 can be varied or is variable, usually depending upon other parameters and/or process conditions of the LNG facility. For example, the ratio of the division of the feed stream 10 may be dependent upon the size of the subsequent cooling systems, the volume or amount of liquid nitrogen available, the size of the LNG facility, and/or one or more other processed conditions or steps such as those described hereinafter.

The first stream 20 and the second stream 30 may advantageously pass through a pressure modification stage 25 comprising a first expander 24 to receive and expand first stream 20 or a compressor 26 to receive and compress the second stream 30, or, as presently shown in FIG. 1, both. In order to remove at least part of the heat of compression from the second stream 30, the compressor 26 may optionally be followed by one or more coolers 36 such as a water and/or air cooler or any other ambient cooler known in the art. However, this may not be necessary when one allows the warmed nitrogen stream 100 to be higher than ambient temperature.

This first stream 20 is then liquefied by a first cooling system 16 comprising one or more heat exchangers. Cooling systems are known in the art, and may include one or more cooling and/or refrigeration processes, generally including at least one heat exchanger. Heat exchangers are well known in the art, and generally involve the passage of at least two streams therethrough, wherein cold energy from one or more streams is heat exchanged or 'recovered' to cool and/or refrigerate at least one other stream running co-currently or counter-currently to the first stream(s). Such means are well known in the art, and are not described further herein.

In FIG. 1, refrigeration for the first cooling system 16 is provided by a liquid nitrogen stream 40. Liquid nitrogen is an available material, usually by liquefaction of air, and can be supplied by a number of sources known in the art, such as ships and other sea-going vessels, static storage tanks, etc, discussed hereinafter.

The liquid nitrogen stream 40 cools and liquefies the first stream 20 by heat exchange herewith, to provide a first liquefied hydrocarbon stream 60 which is >50 mol % liquid, and can be defined herein as such. Preferably, the first liquefied hydrocarbon stream 60 is >90 mol % liquid, or >95 mol % liquid, or >98 mol % liquid, and more preferably 100 mol % liquid.

Following its heat exchange, the liquid nitrogen stream 40 becomes an at least partly evaporated nitrogen stream 70, which is passed to a second cooling system 18, through which the second stream 30 also passes. By heat exchange therebetween, there is provided a second cooled hydrocarbon stream 80. The second cooled hydrocarbon stream 80 is preferably >50 mol % liquid, such as >90 mol % liquid, >95 mol % liquid, or >98 mol % liquid; and more preferably 100 mol % liquid. After heat exchange, the at least partly evaporated nitrogen stream 70 becomes a warmed nitrogen stream 100, optionally being a 100% gaseous nitrogen stream.

The first liquefied hydrocarbon stream 60 is then combined after its liquefaction with the second cooled hydrocarbon stream 80 to provide a combined hydrocarbon stream 90.

The arrangement shown in FIG. 1 is able to fully utilise the cold energy of the liquid nitrogen stream 40 to best match the cooling, preferably liquefaction, requirements of the first stream 20 and second stream 30, by balancing the amount of cold energy required for the first cooling system 16 and second cooling system 18.

Figure 2:
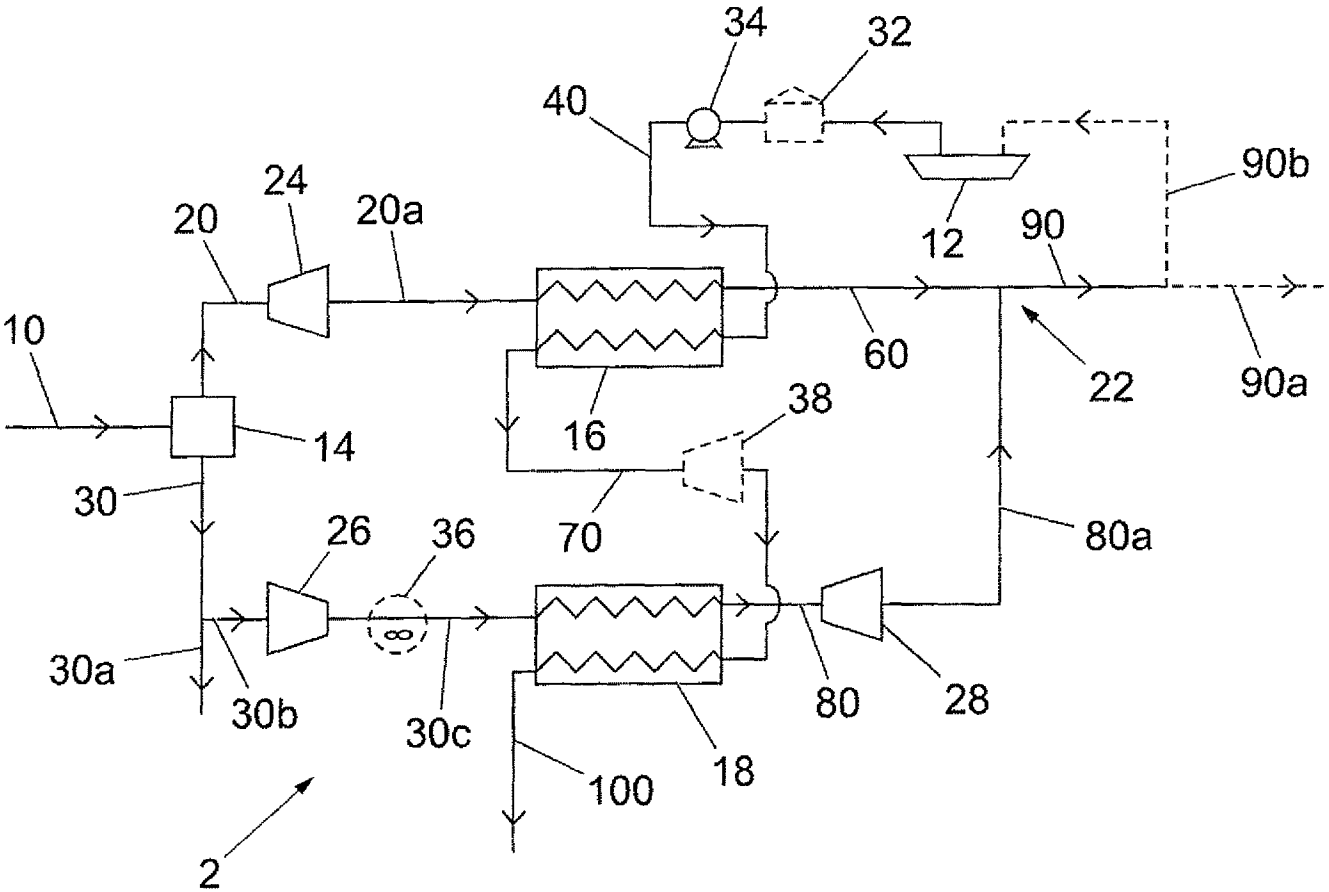
FIG. 2 is a first more detailed scheme of an LNG facility according to a second embodiment of the present invention.

FIG. 2 shows a general arrangement of part of a second LNG facility 2, which could be an enhancement of the arrangement shown in FIG. 1.

FIG. 2 shows a feed stream 10 such as that described hereinbefore, divided by a stream splitter 14 into a first stream 20 and a second stream 30 in a manner as hereinbefore described.

In one embodiment of the present invention, the feed stream 10 is at a greater than ambient pressure, such as >10 bar, or even >40 bar, such as in the range 40-100 bar such as about 60 bar pressure. The provision of a high pressure feed stream of natural gas is known to those skilled in the art.

The first stream 20 and second stream 30 are at substantially the same pressure as the feed stream 10 after their division. However, the pressure of either the first stream 20 or the second stream 30, or the pressure of both the first stream 20 and of the second stream 30, may be changed prior to their cooling against the nitrogen. Thus the present invention provides for the cooling of the first stream 20 and for the cooling of the second stream 30 to be at different pressures. This increases the ability of the present invention to fully utilize the cooling energy of the liquid nitrogen stream 40.

For example, in FIG. 2, the first stream 20 passes through a first expander 24, which may comprise one or more expanders in series, parallel or both. The isenthalpic expansion of the first stream 20 reduces its pressure, but also reduces its temperature. In one example, natural gas at a pressure of about 60 bar and ambient temperature, can be expanded to a pressure of <10 bar, such as 1-3 bar, and be cooled by isenthalpic expansion to below −0° C., such as −50° C. or −60° C.

The expanded first stream 20*a* then passes into a first cooling system 16, in which it is heat exchanged against a liquid nitrogen stream 40 so as to be further cooled and liquefied, and provide a first liquefied hydrocarbon stream 60 which is preferably >50 mol % liquid, such as >90 mol %, >95 mol %, or >98 mol %, more preferably 100 mol % liquid.

One source of liquid nitrogen is from one or more storage tanks. Such tanks are known to the skilled man, and may be static or moving, such as on a sea-going vessel 12 such as a cryogenic transporter ship. Such ships are used to transport liquefied gases such as LNG from one location to another, for example from an LNG export terminal to an LNG import terminal. They can also transport LNG from one or more offshore plants or facilities.

On their return journeys, such transporter ships may be empty, or may carry one or more other liquefied gases such as liquid nitrogen. Liquid nitrogen could be wholly or partly formed at an LNG import terminal where the cold energy from the LNG is used to wholly or partly liquefy the nitrogen, e.g. from air.

In FIG. 2, the source of liquid nitrogen is one or more storage tanks on a sea-going vessel 12, and the liquid nitrogen could be pumped (using one or more pumps 34) directly therefrom to provide the liquid nitrogen stream, or optionally via one or more static tanks 32.

In one embodiment of the present invention, the volume or amount of the liquid nitrogen stream 40 is equivalent to the volume of one or more of the storage tank(s) on the sea-going vessel 12, i.e. the volume or amount of liquid nitrogen transported by the sea-going vessel 12. This volume or amount may vary by ±10%, taking into account other possible uses of liquid nitrogen and/or evaporation thereof prior to use.

Liquid nitrogen is generally at a temperature of below −150° C., such as below −180° C., or even −190° C. Generally, liquid nitrogen is cooler than the liquefaction temperature of natural gas.

Where the temperature of the expanded first stream 20*a* is already below −0° C., such as −60° C., then its subsequent cooling in the first cooling system 16 to for example −160° C. (to provide a first liquefied hydrocarbon stream 60 which is wholly or substantially liquid as hereinbefore described), means that only a certain amount of the cold energy in the liquid nitrogen stream 40 is required to effect this further reduction in temperature, so that the at least partly evaporated nitrogen stream 70 derived from the first cooling system 16 is still at a relatively low temperature, such as below −150° C. or below −160, −170, −180 or even −190° C.

As well as the first and second streams 20, 30, the stream splitter 14 may provide one or more other streams either for cooling or other purposes, such as for use as fuel gas in one or more parts of the LNG facility 2. Such other streams could additionally or alternatively be divided from the first and second streams 20, 30 after the stream splitter 14, and an example of a divided stream 30*a* is shown in FIG. 2 for use as an optional source of fuel gas.

The remaining part 30*b* of the second stream 30, after the provision of any divided stream 30*a*, passes through a compressor 26 which may comprise one or more compressors in series or parallel or both. The compressor increases the pressure of the part second stream 30*b* by at least 20%, possibly 50-200%, and also increases its temperature. Such temperature can optionally be reduced by one or more coolers 36 such as a water and/or air cooler known in the art, to provide a compressed part second stream 30*c*, which passes into a second cooling system 18. The pressure of the compressed part second stream 30*c* may be in the range 80-140 bar, such as in the range 100-130 bar.

The compressor 26 may be driven using power obtained from work extracted from the first stream 20 in the expander 24.

In one group of embodiments, there is no significant change in pressure of the evaporated nitrogen stream 70 other than a de minemus operational pressure loss caused by the heat exchanging in the second cooling system 18 and by the passing the evaporated nitrogen stream 70 from the heat exchanging in the first cooling system 16 to the heat exchanging in the second cooling system 18.

In another group of embodiments, the pressure of the at least partly evaporated nitrogen stream 70 is deliberately changed, preferably reduced, prior to entry into the second cooling system 18. For example, the at least partly evaporated nitrogen stream 70 is expanded in the arrangement shown in FIG. 2 by an optional expander 38 so as to reduce its pressure and temperature prior to the second cooling system 18. The power released may be used to drive the compressor 26.

The action of the second cooling system 18 is known in the art, and provides a second cooled hydrocarbon stream 80. At a high pressure, a hydrocarbon stream such as natural gas may be under supercritical conditions, so that there may not be any definable phase change from gas to liquid as the stream is cooled. However, because the compressed part second stream 30*c* is at a higher pressure than the first expanded stream 20*a*, the enthalpy change needed to cool the part second stream 30*c* is less than the enthalpy change required to cool the first expanded stream 20*a*.

Preferably, the part second stream 30*c* is cooled to below −100° C., more preferably below −150° C. or even below −160° C., in the second cooling system 18.

The second cooling system 18 also provides a warmed nitrogen stream 100.

The second cooled hydrocarbon stream 80 then passes through a second expander 28, which, following isenthalpic expansion, provides a more liquefied second hydrocarbon stream 80*a*, especially where the pressure of a cooled super critical stream is released. Preferably, the more liquefied second hydrocarbon stream 80*a* is expanded to a transportable pressure, such as atmospheric pressure (about 1 bar) or nearby. The power released may be used to drive the compressor 26.

In general, it is desired for either the first liquefied hydrocarbon stream 60 and/or the second cooled hydrocarbon stream 80 and/or the more liquefied second hydrocarbon stream 80*a* and/or the combined hydrocarbon stream 90 be provided at a transportable pressure, such as atmospheric pressure (about 1 bar) or nearby.

Two or more of any expanders and/or any compressors used in the present invention could be linked or combined, for example mechanically such as in a compounder, in a manner known in the art, to utilise or even exclusively utilise any energy or work created by one unit, usually by an expander in the expansion of a stream, to help power or fully power or drive one or more of the other units, usually a compressor. This further reduces capital and running costs, especially in a small facility and/or where space is limited.

In another embodiment of the present invention, the parameters and process conditions of the cooling of the first stream 20 and the cooling of the second stream 30 are such as to provide a first cooled hydrocarbon stream 60 and second cooled hydrocarbon stream 80, or an expanded second cooled hydrocarbon stream 80*a*, having the same or similar parameters, especially temperature and pressure, such that they can be combined by a combiner 22, to provide a combined cooled hydrocarbon stream 90.

The combined cooled hydrocarbon stream 90 is preferably a liquid natural gas stream. The combined stream 90 may be conveyed from the LNG facility to as shown by line 90*a*, and/or may be conveyed as a stream 90*b* into a sea-going vessel such as the sea-going vessel 12 which provided the liquid nitrogen stream 40. In particular, the arrangement shown in FIG. 2 may provide a volume or amount of a cooled hydrocarbon stream such as LNG via stream 90*b*, which is the same or similar (±10%) to the volume or amount of liquid nitrogen provided as the liquid nitrogen stream 40. Thus, there is better efficiency by the rapid or immediate replacement of a cooled product in the sea-going vessel 12 by another cooled product, minimising or avoiding an increase in temperature in the cold storage parts of the sea-going vessel 12 (and thus their inefficient need to be re-cooled).

The arrangement in FIG. 2 is also able to optimise capital expenditure by minimising the number of lines required to effect liquefaction of a gaseous hydrocarbon stream such as natural gas. This is especially advantageous where space for the facility is restricted, for example off-shore or an otherwise floating facility. In addition or alternatively, the arrangement in FIG. 2 is able to optimise the balance of the use of cold energy from a liquid nitrogen stream by the differential in the temperature and pressure of the first and second streams 20, 30 following their expansion and compression.

Where the feed stream 10 is divided into more than two streams, this may comprise a different arrangement of pressure and temperature adjustments in each stream and/or of the liquid nitrogen stream as it passes between each cooling system for the cooling of each stream, to optimise energy use.

Thus, the present invention preferably provides a method of cooling a gaseous hydrocarbon stream such as natural gas by the division of the gaseous hydrocarbon stream into two or more streams that are cooled at different pressures and/or cooled by a liquid nitrogen stream being at a different pressure for cooling each stream. This optimises the use of the cooling energy in the liquid nitrogen stream 40, and thus maximises the volume or amount of cooled hydrocarbon, preferably liquid natural gas, that is able to be provided by the liquid nitrogen stream 40. The pressure of the liquid nitrogen stream 40 may be relatively low, at least below 10 bara and preferably around atmospheric pressure such as below 2 bara or between 1 and 2 bara. An advantage of the liquid nitrogen being around atmospheric pressure is that the liquid nitrogen can be shipped at a pressure of about atmospheric, and that little or no power is required to pump the liquid nitrogen to higher pressure.

In the arrangement shown in FIGS. 1 and 2, the first cooled hydrocarbon stream 60, or the second cooled hydrocarbon stream 80 or its expanded stream 80*a*, or the combined cooled hydrocarbon stream 90, or a combination of same, may pass through one or more further cooling stages, such as an end-flash, so as to either further liquefy the cooled hydrocarbon, and/or reduce the gaseous content of the cooled hydrocarbon.

Figure 3:
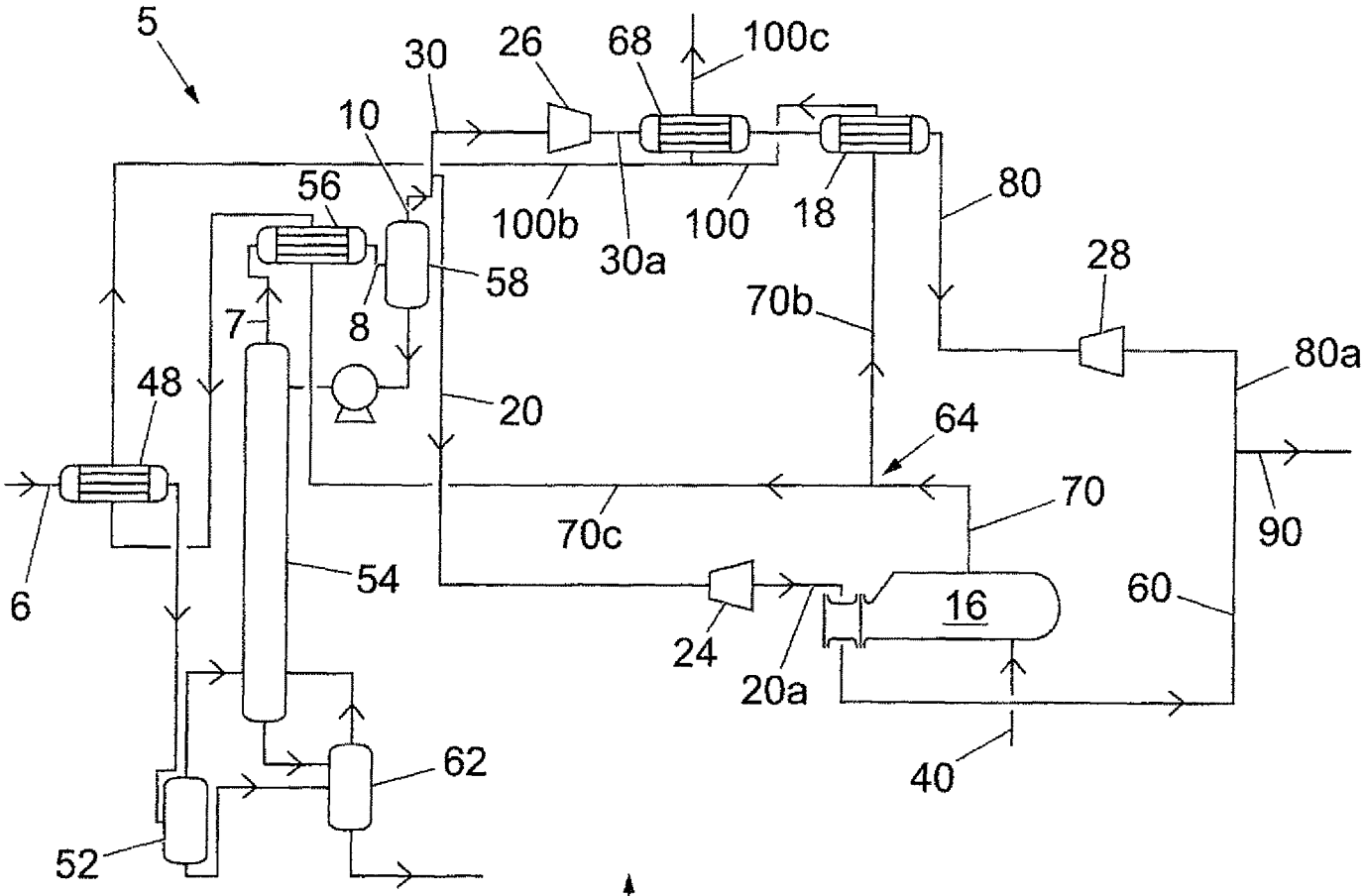
FIG. 3 is a second more detailed scheme of an LNG facility, according to a third embodiment.

FIG. 3 shows a general arrangement of part of a third LNG facility 4, which could be an enhancement of the arrangements shown in FIGS. 1 and 2.

FIG. 3 shows a feed stream 10 divided into first and second streams 20 and 30, which are expanded and compressed respectively, prior to passage through first and second cooling systems, 16, 18, to provide first and second cooled hydrocarbon streams 60 and 80. The latter stream 80 is expanded to provide an expanded second cooled hydrocarbon stream 80*a*, which can then be combined to form a combined cooled hydrocarbon stream 90 such as LNG.

The feed stream 10 is provided from a natural gas liquids (NGL) extraction system 5. In the NGL extraction system 5, an initial stream 6 passes through a first heat exchanger 48, prior to passage through a gas/liquid separator 52, the overhead stream from which passes through an NGL extraction column 54. The overhead stream 7 from the extraction column 54 passes through a second heat exchanger 56, and the cooled stream 8 therefrom then passes through a second gas/liquid separator 58 to provide the feed stream 10.

Reflux arrangements using further streams from the first and second gas/liquid separators 52, 58 are also shown, as well as a third gas/liquid separator 62 for a bottom reflux arrangement in the extraction column 54. The nature, arrangement and process parameters for an NGL extraction process are well known in the art, and are not described in any further detail herein.

Cooling for the second heat exchanger 56 followed by cooling for the first heat exchanger 48 is provided by a divided fraction of the at least partly evaporated nitrogen stream 70 from the first cooling system 16. The division of the at least partly evaporated nitrogen stream 70 is provided by a divider 64, which provides a first nitrogen stream fraction 70*b* and a second nitrogen stream fraction 70*c*.

The first fraction 70*b* provides the cooling to the second cooling system 18 in a manner as hereinbefore described, from which there is provided a warm nitrogen stream 100. The second nitrogen stream fraction 70*c* provides the cooling to the second heat exchanger 56 and the first heat exchanger 48 serially, which warmed nitrogen stream 100*b* therefrom is then combined with the other warmed nitrogen stream 100, to pass through a third heat exchanger 68. The third heat exchanger 68 precools the expanded second stream 30*a* prior to the second cooling system 18, which provides a further warmed nitrogen stream 100*c*.

The arrangement shown in FIG. 3 further utilises the cold energy of the liquid nitrogen stream 40, by using part of the at least partly evaporated nitrogen stream 70 in an NGL extraction process 5.

The arrangement shown in FIG. 3 also shows the ability of the present invention to be involved in various methods for cooling a gaseous hydrocarbon stream as well as other processes, such as NGL extraction, so as to optimise the cold energy of a liquid nitrogen stream.

Table 1 gives an overview of estimated pressures and temperatures and phase compositions of streams at various parts of an example process of FIG. 2.

TABLE 1

| Line | Pressure (bar) | Temperature (° C.) | Phase composition* |
|---|---|---|---|
| 10 | 63 | +20 | V |
| 20 | 63 | +20 | V |
| 20a | 2.5 | −60 | V |
| 30c | 130 | +85 | V |
| 60 | 1 | −164 | L |
| 80 | 129 | −163 | V/L |
| 80a | 1 | −164 | L |
| 90 | 1 | −164 | L |
| 40 | 1-2 | −196 | L |
| 70 | 1-2 | −190 | L |
| 100 | 1-2 | +77 | V |

V = vapour,
L = Liquid

The cooling duty of the first cooling system 16 in the same example process based on FIG. 2 was 16MW, and for the second cooling system 18 was 12MW, using a warm side approach of 8° C. for the second cooling system 18, and a split ratio in splitter 14 whereby the a mass flow of the first stream was 48% of the mass flow of the hydrocarbon feed stream 10, and the mass flow of the second stream was 52% of the mass flow of the hydrocarbon feed stream 10.

The person skilled in the art will understand that the present invention can be carried out in many various ways without departing from the scope of the appended claims.

What is claimed is:

1. A method of liquefying a gaseous hydrocarbon stream, the method at least comprising the steps of:

(a) providing a feed stream comprising the gaseous hydrocarbon stream at an elevated pressure;

(b) dividing the feed stream of step (a) to provide at least a first stream and a second stream;

(c) expanding the first stream or compressing the second stream, or both;

(d) cooling and liquefying the first stream downstream of step (c) by heat exchanging exclusively against a liquid nitrogen stream that is at a pressure of less than 10 bara, to provide a first liquefied hydrocarbon stream and an at least partly evaporated nitrogen stream; and (e) cooling and liquefying the second stream downstream of step (c) by heat exchanging against the at least partly evaporated nitrogen stream of step (d) without invoking a significant change in pressure of the evaporated nitrogen stream other than a de minemus operational pressure loss caused by the present heat exchanging of step (e) and passing the evaporated nitrogen stream from the heat exchanging of step (d) to the present heat exchanging of step (e), wherein the cooling of the first stream and second stream is carried out at different pressures.

2. A method as claimed in claim 1, wherein step (e) is followed by step (f): expanding the second liquefied hydrocarbon stream to provide an expanded second liquefied hydrocarbon stream.

3. A method as claimed in claim 2, wherein step (f) is followed by step (g): combining the first liquefied hydrocarbon stream with the expanded second liquefied hydrocarbon stream to provide a combined hydrocarbon stream.

4. A method as claimed in claim 1, wherein in step (c) the first stream is expanded prior to step (d), thereby reducing the pressure to a pressure of between 1 and 15 bar.

5. A method as claimed in claim 1, wherein in step (c) the second stream is compressed prior to step (e), to at least 120% of the elevated pressure in step (a).

6. A method as claimed in claim 5, wherein the second stream is compressed to a pressure of between 80 and 140 bar.

7. A method as claimed in claim 1, wherein the liquid nitrogen stream is provided from one or more storage tanks.

8. A method as claimed in claim 7, wherein the liquid nitrogen stream is provided from one or more storage tanks on a sea-going vessel, and the volume of the liquid nitrogen stream for step (d) is equivalent to the volume of the liquid fractions of the first liquefied hydrocarbon stream and the second liquefied hydrocarbon stream together.

9. A method as claimed in claim 8, wherein the one or more storage tanks can store and transport the first liquefied hydrocarbon stream and the second cooled hydrocarbon stream.

10. A method as claimed in claim 1, wherein the first stream comprises 30 mass % to 70 mass % of the feed steam.

11. A method as claimed in claim 1, wherein the feed stream in step (a) is provided from a natural gas liquids extraction system, and wherein the at least partly evaporated nitrogen stream of step (d) is divided into two or more fractions to create at least a first separate nitrogen stream and a second separate nitrogen stream, which second separate nitrogen stream is employed to provide cooling to the natural gas liquids extraction system.

12. A method as claimed in claim 1, wherein the second stream in step (e) is cooled and liquefied without invoking a significant pressure reduction in the second stream during the cooling and liquefying, other than a de minemus operational pressure loss caused by the heat exchanging, thereby providing the second liquefied hydrocarbon stream at substantially the same pressure as the pressure of the second stream after step (C).

13. An apparatus for liquefying a hydrocarbon stream, the apparatus comprising:

a stream splitter to divide the hydrocarbon stream into at least a first stream and a second stream;

a pressure modification stage comprising a first expander to receive and expand the first stream or a compressor to receive and compress the second stream, or both;

a first cooling system, downstream of the pressure modification stage, through which the first stream and a liquid nitrogen stream that is at a pressure of less than 10 barn can heat exchange to provide a first liquefied hydrocarbon stream and an at least partly evaporated nitrogen stream;

a second cooling system, downstream of the pressure modification stage, through which the second stream, at a higher pressure than the first stream, and the at least partly evaporated nitrogen stream can heat exchange, to provide a second liquefied hydrocarbon stream and a warmed nitrogen stream at substantially the same pressure as the at, least partly evaporated nitrogen stream, and a connection conduit, free from pressure modification means and fluidly connecting the first cooling system to the second cooling system, to allow the at least partly evaporated nitrogen stream to pass from the first cooling system to the second cooling system without invoking a significant change in pressure other than a de minemus operational pressure loss caused by the evaporated nitrogen stream from the first cooling system to the second cooling system.

14. An apparatus as claimed in claim 13, further comprising: a second expander to expand the second liquefied hydrocarbon stream.

15. An apparatus as claimed in claim 14, further comprising: a combiner to combine the first liquefied hydrocarbon stream and the second cooled hydrocarbon stream downstream of the second expander.

16. An apparatus as claimed in claim 13, wherein the second cooling system is free of pressure modification means such that the second liquefied hydrocarbon stream downstream of the second coding system is at substantially the same pressure as the pressure of the second stream upstream of the second cooling system other than a de minemus operational pressure loss caused by the second cooling system.

17. A method as claimed in claim 1, wherein the liquid nitrogen stream in step (d) is at a pressure of less than 2 bara.

* * * * *